US008502665B2

(12) United States Patent
Boudreau

(10) Patent No.: US 8,502,665 B2
(45) **Date of Patent: *Aug. 6, 2013**

(54) SECURITY FENCE FOR SWIMMING POOLS

(76) Inventor: Eric Boudreau, Saint-Lambert de Lauzon (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/424,746

(22) Filed: Mar. 20, 2012

(65) Prior Publication Data

US 2012/0175578 A1 Jul. 12, 2012

Related U.S. Application Data

(63) Continuation of application No. 12/375,557, filed as application No. PCT/CA2007/001355 on Aug. 1, 2007, now Pat. No. 8,164,448.

(60) Provisional application No. 60/834,486, filed on Aug. 1, 2006.

(51) Int. Cl.
*G08B 13/00* (2006.01)
*G08B 13/14* (2006.01)
*G08B 21/00* (2006.01)

(52) U.S. Cl.
USPC ..... 340/550; 340/541; 340/686.2; 340/686.3; 340/686.4; 340/686.1; 256/3; 256/12; 256/16

(58) Field of Classification Search
None
See application file for complete search history.

(56) References Cited

U.S. PATENT DOCUMENTS 3,648,301 A 3/1972 Wiley
3,654,637 A 4/1972 Lankheet
3,778,804 A 12/1973 Adair
3,789,435 A 2/1974 Heisner
3,877,085 A 4/1975 Bukaitz et al.
3,994,479 A 11/1976 Johannesson
4,280,477 A 7/1981 Divine
4,916,433 A * 4/1990 ver Loren van Themaat ..... 340/550
5,102,103 A * 4/1992 Putnam ..... 256/12
5,152,508 A 10/1992 Fish
5,168,584 A 12/1992 Peebles
5,217,265 A * 6/1993 Lerner et al. ..... 292/200

(Continued)

FOREIGN PATENT DOCUMENTS

FR 2799784 A1 4/2001
WO 2004/007873 A1 1/2004

(Continued)

OTHER PUBLICATIONS

USPTO NOA mailed Dec. 21, 2011 in connection with U.S. Appl. No. 12/375,557.

(Continued)

*Primary Examiner* — Julie Lieu
(74) *Attorney, Agent, or Firm* — Ladas & Parry LLP

(57) ABSTRACT

A security fence for swimming pools is provided to be so positioned as to surround the water of a swimming pool. The security fence comprises fence sections which are linked to an alarm system. The fence sections are moveable between a non-signaling position and an alarm signaling position. When the fence sections are in the non-signaling position and a given fence section is engaged with sufficient force it is moved to the alarm signaling position thereby signaling the alarm. The foregoing prevents a user, such as a child, from entering the pool water when the alarm system has been activated.

9 Claims, 16 Drawing Sheets

U.S. PATENT DOCUMENTS

| | | | | |
|---|---|---|---|---|
| 5,243,325 | A * | 9/1993 | Marin et al. | 340/545.2 |
| 5,434,556 | A | 7/1995 | Donohoo | |
| 5,438,316 | A * | 8/1995 | Motsinger et al. | 340/541 |
| 5,461,364 | A | 10/1995 | Sanford, Jr. et al. | |
| 5,473,310 | A | 12/1995 | Ko | |
| 5,548,275 | A | 8/1996 | Shambayati et al. | |
| 5,553,833 | A | 9/1996 | Bohen | |
| 5,711,110 | A * | 1/1998 | Williams | 49/35 |
| 5,786,761 | A | 7/1998 | Hui | |
| 6,130,615 | A | 10/2000 | Poteet | |
| 6,278,373 | B1 | 8/2001 | Jaurigue et al. | |
| 6,789,786 | B1 | 9/2004 | Schatzberg | |
| 7,003,816 | B1 | 2/2006 | Bowlby | |
| 2005/0116213 | A1 * | 6/2005 | Dahowski et al. | 256/24 |
| 2006/0101784 | A1 * | 5/2006 | Price | 52/782.1 |
| 2007/0278467 | A1 * | 12/2007 | Ash | 256/22 |

FOREIGN PATENT DOCUMENTS

| | | | |
|---|---|---|---|
| WO | 2004/102501 | A1 | 11/2004 |
| WO | 2005/031089 | A2 | 4/2005 |
| WO | 2005/061827 | A1 | 7/2005 |

OTHER PUBLICATIONS

International Search Report: mailed Nov. 23, 2007; PCT/CA2007/001355.

* cited by examiner

SECURITY FENCE FOR SWIMMING POOLS

FIELD OF THE INVENTION

The present invention generally relates to swimming pools. More specifically but not exclusively, the present invention is concerned with a security fence for swimming pools.

BACKGROUND OF THE INVENTION

Children drowning in home pools has been a major public concern for sometime and has escalated with the popularity of backyard pools.

In many unfortunate instances, children have climbed above ground pools either to try and swim on their own or to retrieve an article such as a ball or a flying disc such as a Frisbee™ for example and have fallen into the pool and drowned. This has occurred in instances when there is no parental supervision or when a supervisor has entered the home for only a few short minutes. It takes only a few minutes for a child to drown.

Safety systems for preventing the foregoing are usually large, cumbersome and expensive apparatuses that have yet to be popularized even though fatalities due to accidents like those mentioned above continue to rise. Furthermore, most existing systems deal with accidents involving children when they have already fallen into the pool water and not before and as such these systems are not preventive.

OBJECTS OF THE INVENTION

An object of the present invention is therefore to provide a security fence for swimming pools.

SUMMARY OF THE INVENTION

In accordance with an aspect of the present invention, there is provided a security fence for a swimming pool, the fence comprising fence sections linked to an alarm system, the fence sections being moveable between a non-signaling position and an alarm signaling position, wherein when the fence sections are in said non-signaling position and a given fence section is moved to the alarm signaling position the alarm system is signaled.

In accordance with another aspect of the present invention, there is provided a security system for a swimming pool comprising: a security fence for being mounted about the swimming pool so as to surround the pool water; the security fence comprising movable fence sections being movable between a non-signaling position and an alarm signaling position; and an alarm system operationally linked to each fence section, wherein when a given fence section is moved to the alarm signaling position, the alarm system is signaled.

In accordance with a further aspect of the present invention, there is provided a fence section for providing a security fence for a swimming pool, the fence section comprising: at least one pair of post members for being mounted to the pool; a panel pivotally mountable to the post members at each lateral side thereof so as to be pivotable between non-signaling and alarm signaling positions, the panel providing for being operatively linked to an alarm system which is signaled when the panel is in the alarm signaling position; wherein a plurality of fence sections can be mounted in a side by side fashion about the pool in order to provide the security fence.

In accordance with yet another aspect of the present invention, there is provided a panel for a security fence for a swimming pool, the security fence including post members to be mounted to the pool; the panel comprising: lateral sides thereof for being pivotally mounted to the post members so as to be movable between a non signaling position and an alarm signaling position; and an alarm signaling mechanism for being operationally linked to an alarm system so as to signal the alarm system when the panel is in the alarm signaling position.

In accordance with yet a further aspect of the present invention, there is provided a post member for a security fence for a swimming pool, the fence being operationally linked to an alarm system and including panels that are movable between non-signaling and alarm signaling positions, the post member comprising: a platform for being mounted to the pool; and an upstanding portion generally upstanding from the platform and comprising pivots protruding from each lateral side thereof so as to pivotally receive panels.

In accordance with still another aspect of the present invention, there is provided a method of securing a swimming pool against intrusion, the method comprising: providing a fence about the pool water; linking the fence to an alarm system; and providing for the alarm system to be signaled when the fence is engaged with sufficient force.

The term "fence" should be construed herein to include without limitation a barrier, a separator, a wall, a boundary, a border, an enclosure, a surrounding, a divider, a fixture, or any type of access preventing structure and the like.

The term "fence section" should be construed herein to include without limitation any portion of a fence that can provide signaling and non-signaling positions.

Other objects, advantages and features of the present invention will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated the invention relates to a security system for a swimming pool. A barrier or fence is placed around the pool surrounding the water. This fence is made of a plurality of fence sections. The fence sections are configured to be movable when sufficient force is applied thereon. When a fence section is moved it signals an alarm that a non-permissible intrusion into the pool was attempted. In a non-restrictive embodiment, this system prevents unsupervised children from entering the swimming pool by signaling an alarm so that a supervisor or other authority may come to the rescue.

With reference to FIGS. 1 to 10B a non-restrictive illustrative embodiment of the present invention will now be described so as to exemplify the invention and by no means limit the scope thereof.

Figure 1:
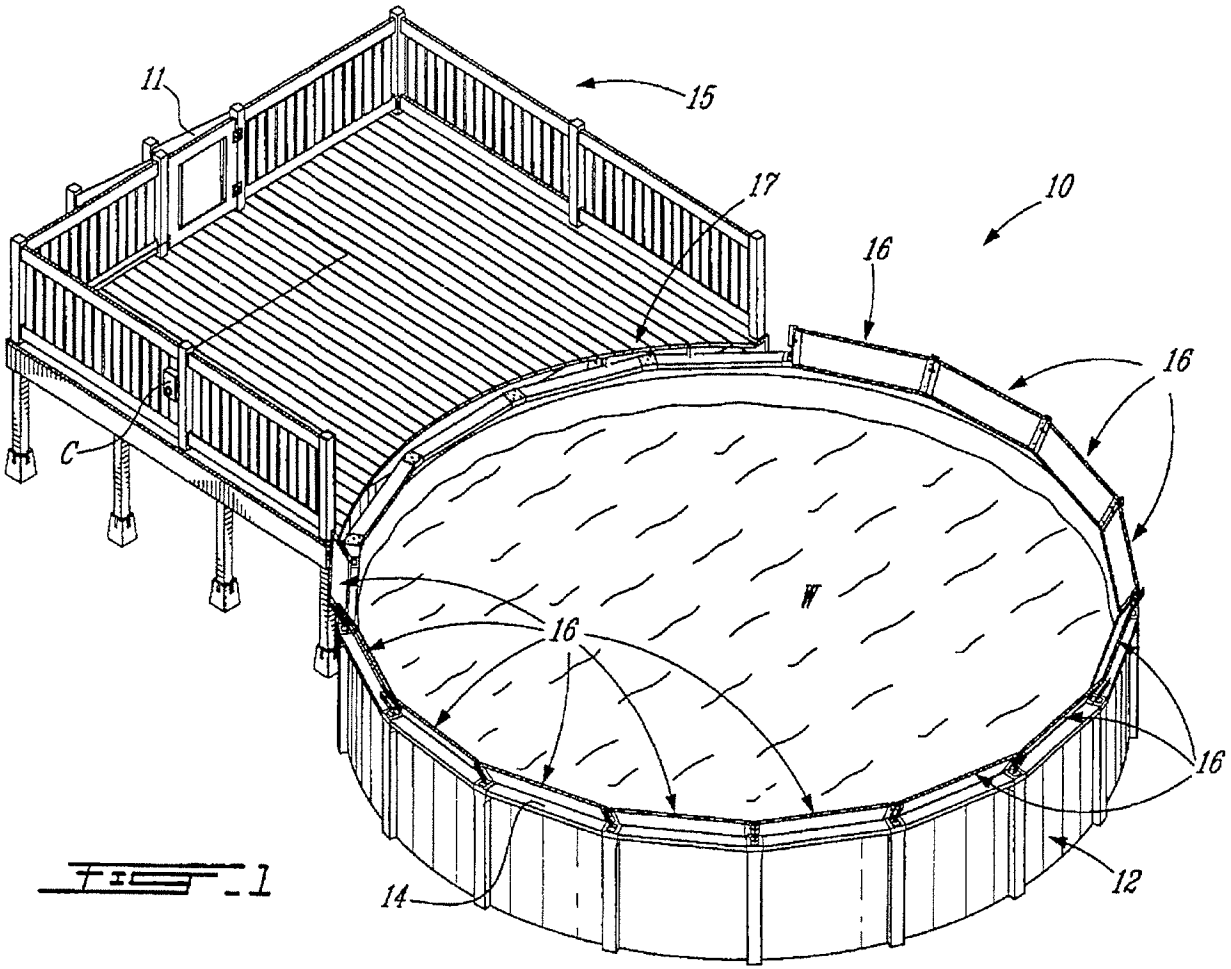
FIG. 1 a perspective view of a swimming pool adjacent to a deck and having the security fence of the invention in accordance with a non-restrictive illustrative embodiment thereof.

FIG. 1 shows a security fence 10 for a swimming pool 12. More particularly, the fence 10 surrounds the water W of the pool 12. In this example, the fence 10 is mounted to the swimming pool 12, more specifically it is mounted to the rim or perimeter 14 of the pool 12. The pool 12 is exemplified in the form of an above-ground pool and shown to be adjacent a pool deck 15. The fence 10 includes plurality of fence sections or modules 16. The area 17 of the pool 12 immediately adjacent to the deck 15 does not include any fence sections 16. Hence, the fence 10 does not need to fully surround the pool 12.

Figure 2:
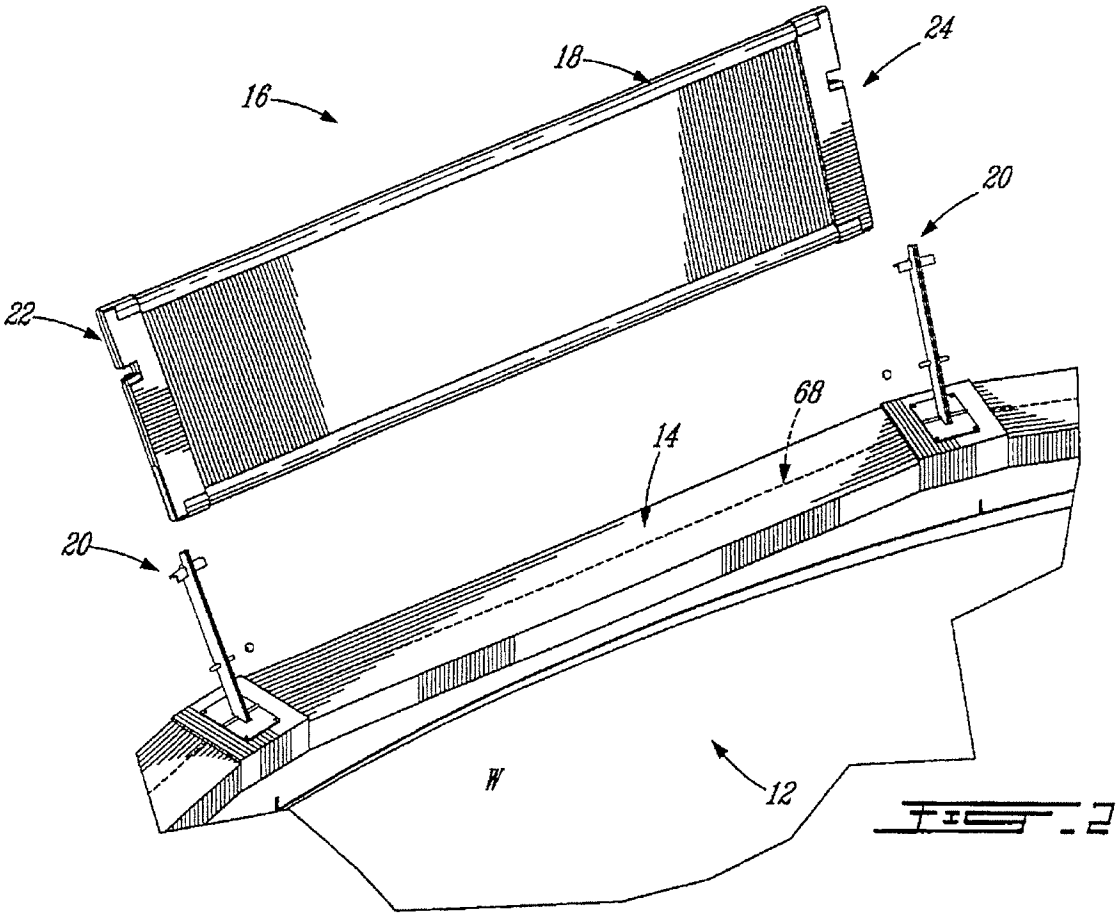
FIG. 2 is front partially exploded perspective view of a fence section of the security fence of FIG. 1.
Figure 7:
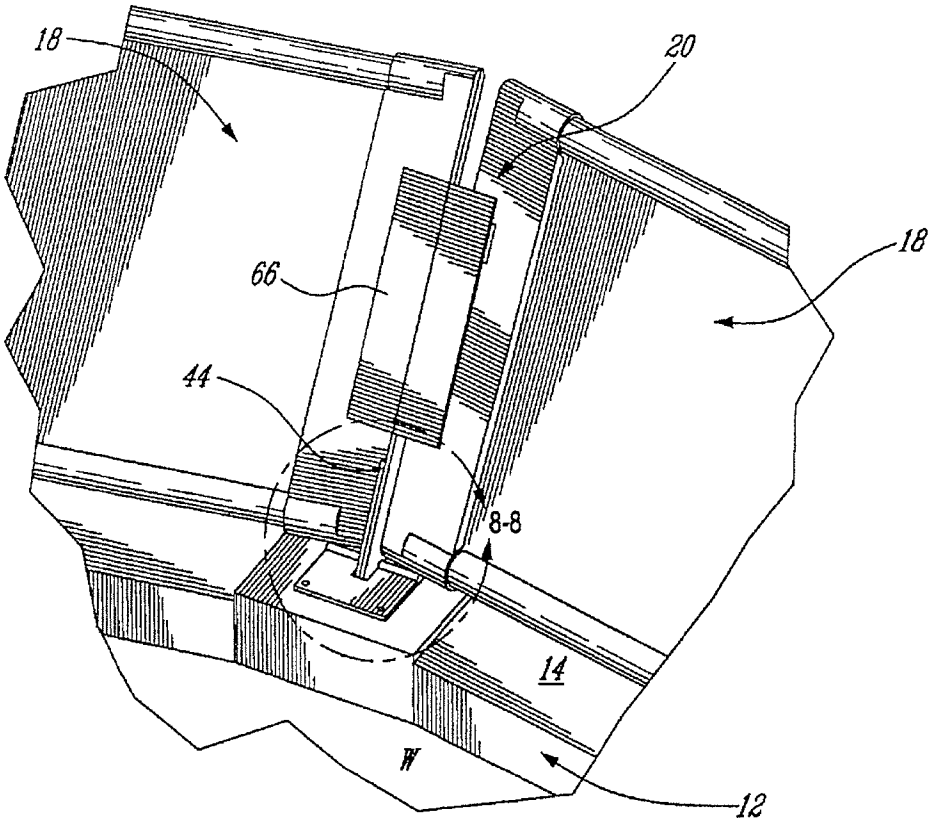
FIG. 7 is a front perspective view of a pair of panels of the fence of FIG. 1 mounted to a given post member of the fence of FIG. 1.

With reference to FIG. 2, each fence section 16 includes panels 18 moveably mounted to post members 20 at each lateral side thereof 22 and 24. In this way, each post member 20 may have a panel 18 at each side thereof as shown in FIG. 7.

Figure 3:
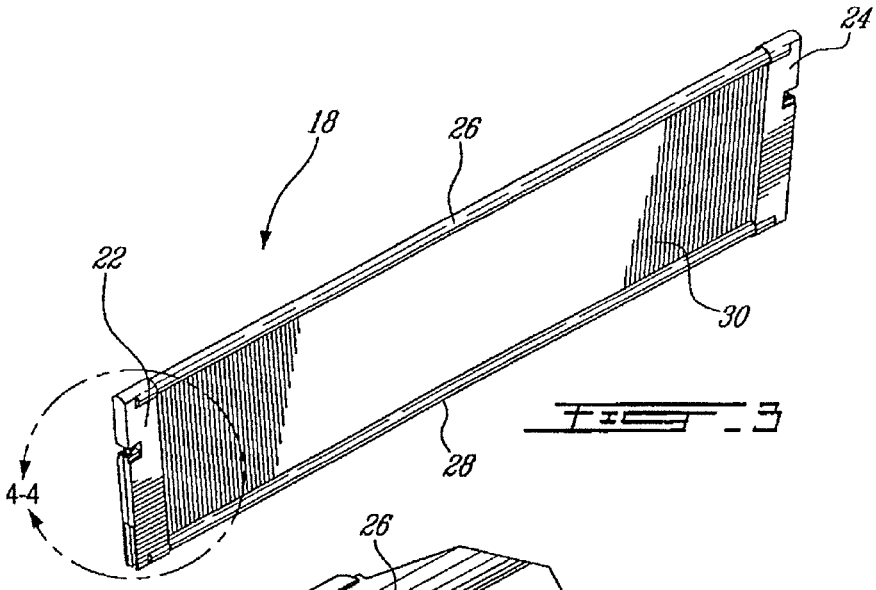
FIG. 3 is front perspective view of the panel of the fence section of FIG. 2.
Figure 4:
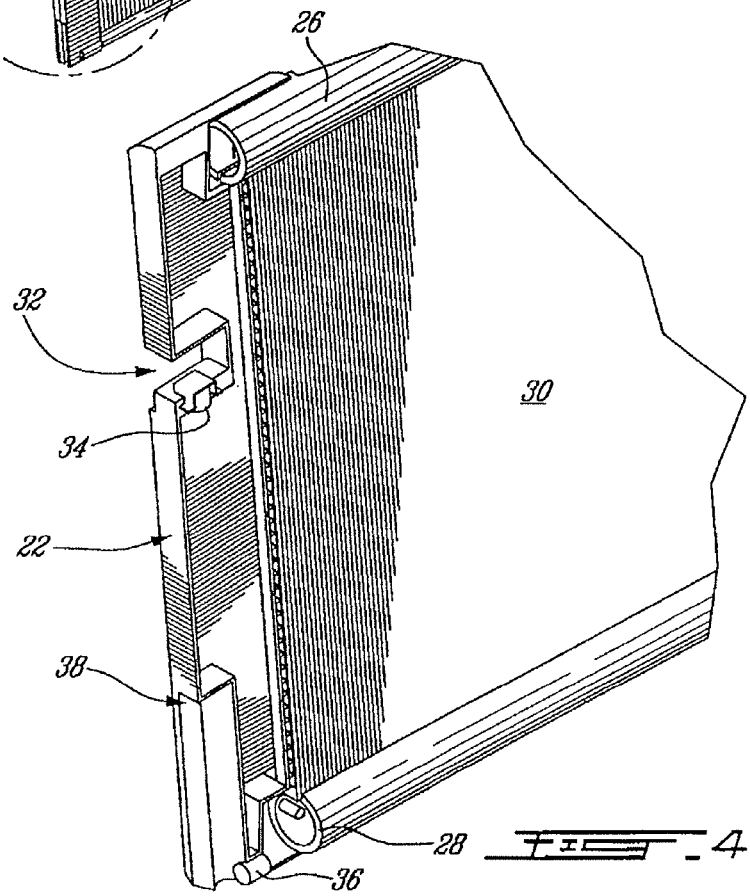
FIG. 4 is an enlarge view of portion 4-4 of FIG. 3.

Referring to FIGS. 3 and 4, the panels 18 include top and bottom frame members 26 and 28, respectively, being interconnected to the lateral frame members 22 and 24 (which define the lateral sides of the panels 18). Frame members 22, 24, 26 and 28 define a generally rectangular frame for supporting a screen 30. Each lateral frame member 22 and 24 includes a top recess 32 including a post mating element 34 in the form of a magnet, a bottom alarm signalling member 36 in the form of a magnet and median post receiving element 38 in the form of pivot receiving aperture.

Figure 5:
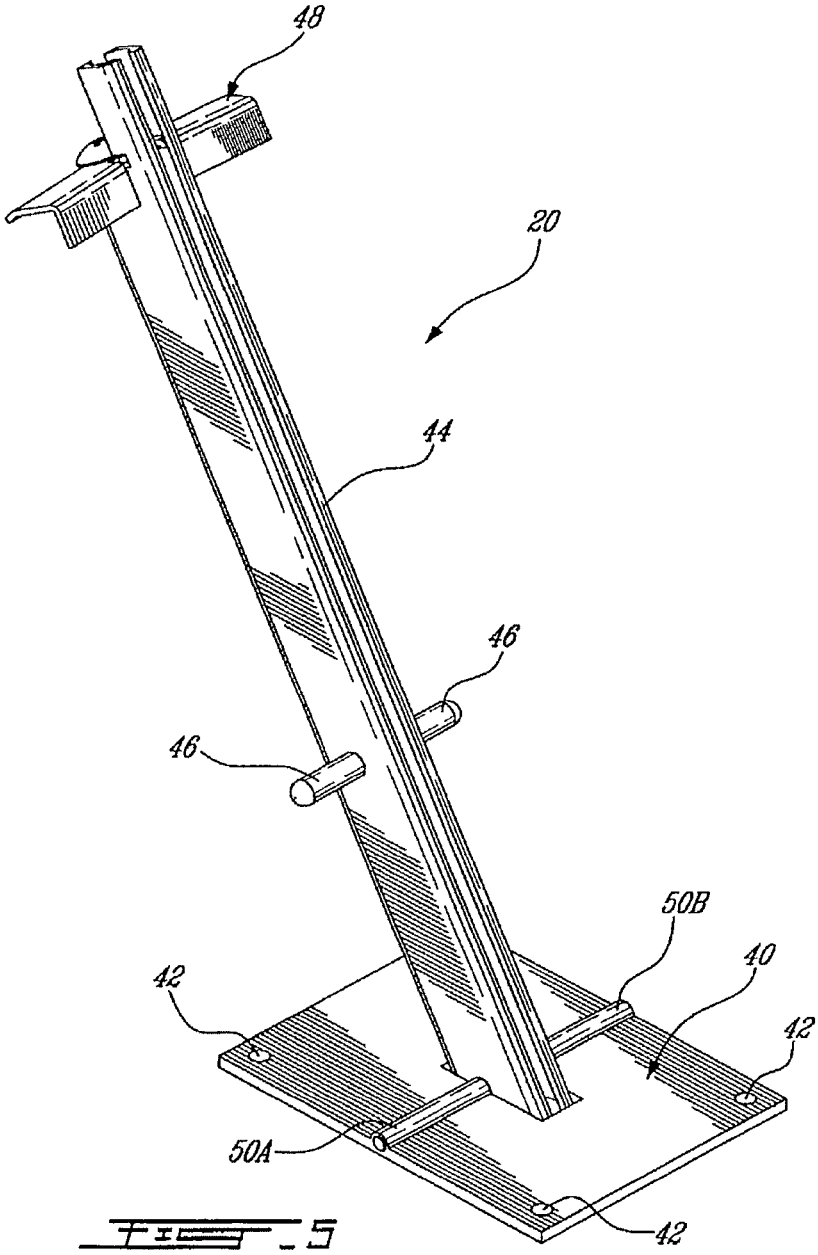
FIG. 5 is front perspective view of the post member of the fence section of FIG. 2.

With reference to FIG. 5, each supporting post member 20 includes a platform 40 that is fixed to the pool 12 via fasteners 42. A pole 44 is generally upstanding from the platform 40. In this non-limiting example, the pole 4 is inclined away from the water W of the pool 12. The pole 44 defines two lateral sides each having a pivot member 46 for pivotally mounting panels 18 thereto via their pivot apertures 38. The pole 44 also includes a top panel-mating element 48. The platform 40 includes a pair of alarm switches 50A and 50B at each side of the pole 44 (both of which can be generally denoted as 50 herein).

Figure 6A:
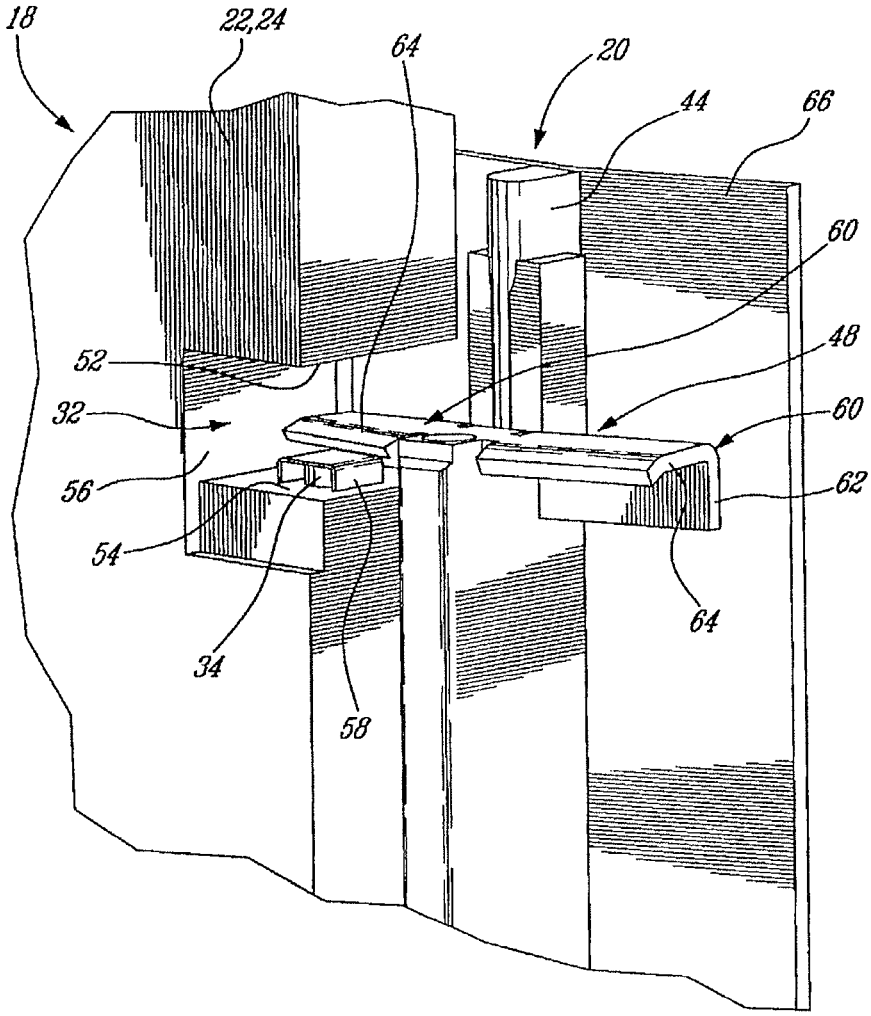
FIG. 6A is a perspective view of the mutually mating elements of the panel and the post member of the fence section of FIG. 2.

With reference to FIG. 6A, the recess 32 of the panel 16 defines a top shoulder 52, a bottom shoulder 54 and an inner median wall 56. The magnet 34 is secured to the bottom shoulder 54 via a metallic securing member 58. The post panel-mating element 48 is L-shaped and includes a pair of wing portions 60 protruding from each lateral side of the pole 44. Each wing portion 60 includes a vertical section 62 and a horizontal section 64. The metallic horizontal section 62 magnetically mates with magnet 34, while the vertical section abuts the panel 18. This magnet engagement between the panel 18 and the post member 20 provides for needing a suitably sufficient force in order to separate the two. In an alternative embodiment shown in FIG. 6B, the panel 18 includes a recess 32B which defines top and bottom shoulders 52B and 54B, respectively, a median wall 56B therebetween, and back wall 57 having a plane generally orthogonal to the plane of the median wall 56B. The post member 20 includes an L-shaped post panel-mating element 48B having wing sections 60B, each having a metallic vertical member 62B and horizontal section 64B. The magnet 34 is secured to the back wall 57 via a securing member 58B and magnetically mates with the metallic vertical member 62B.

Figure 6B:
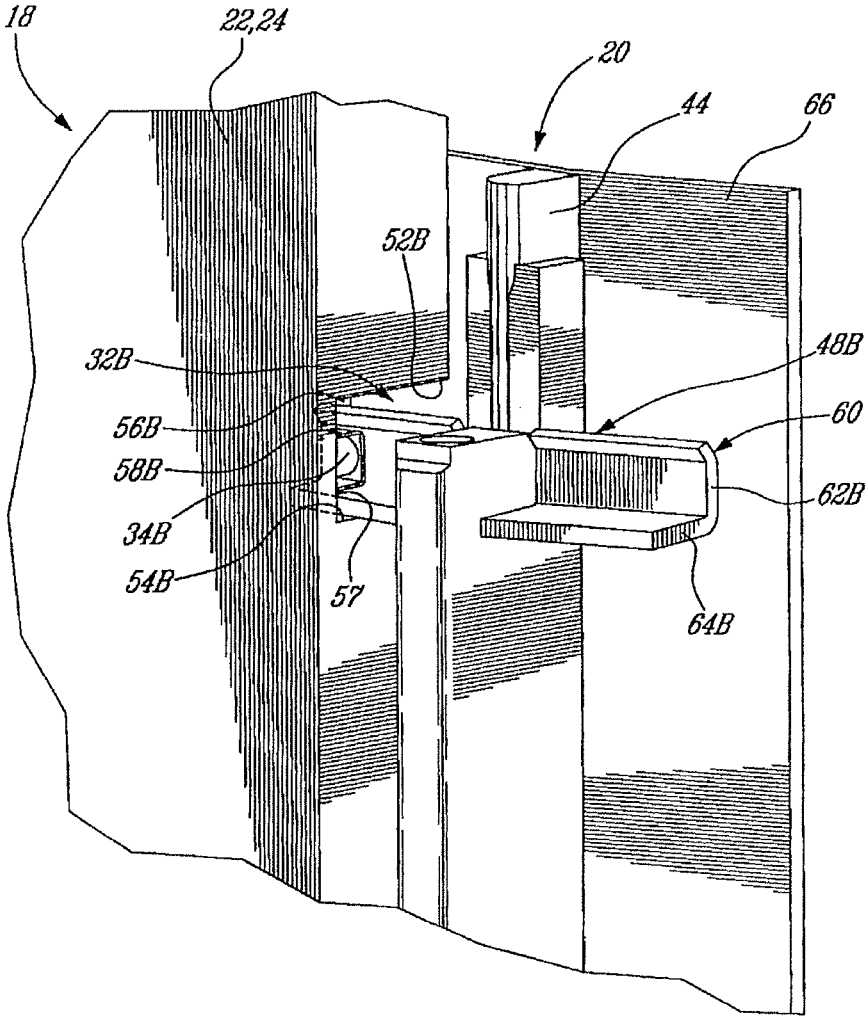
FIG. 6B is a perspective view of the mutually mating elements of the panel and the post member in accordance with an alternative non-restrictive illustrative embodiment of the present invention.

With reference to FIGS. 6A, 6B and 7, the post member 20 includes a plate 66 mounted to the pole 44 on the side thereof facing the pool water W. The panels 18 at each side of the post member 20 abut the plate 66 thereby preventing these stopper panels 18 from pivoting in the direction of the pool water W.

Figure 8:
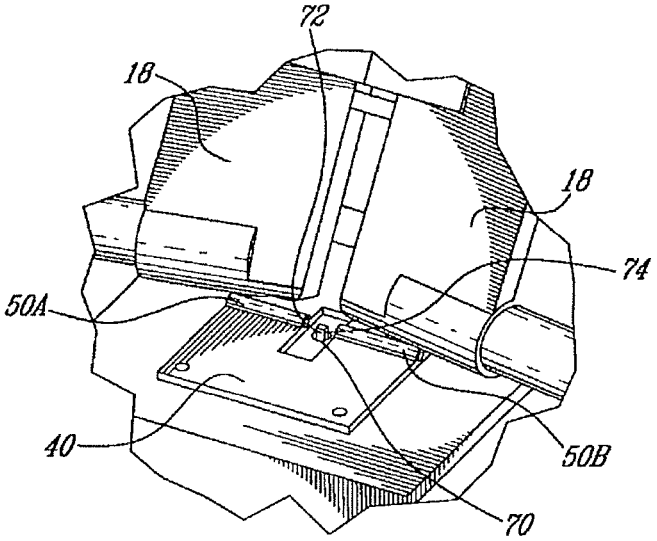
FIG. 8 is an enlarged and partially exploded view of the portion 8-8 of FIG. 7.
Figure 9B:
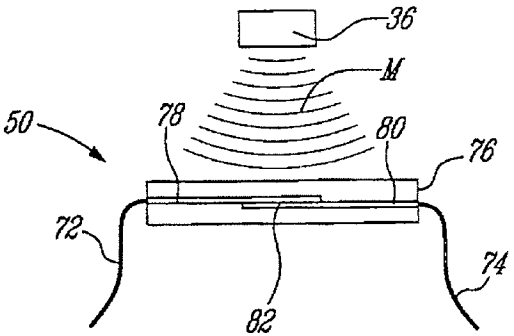
FIG. 9B is a schematic view of the alarm mechanism of the Fence of FIG. 1 in the non-signaling position.
Figure 9A:
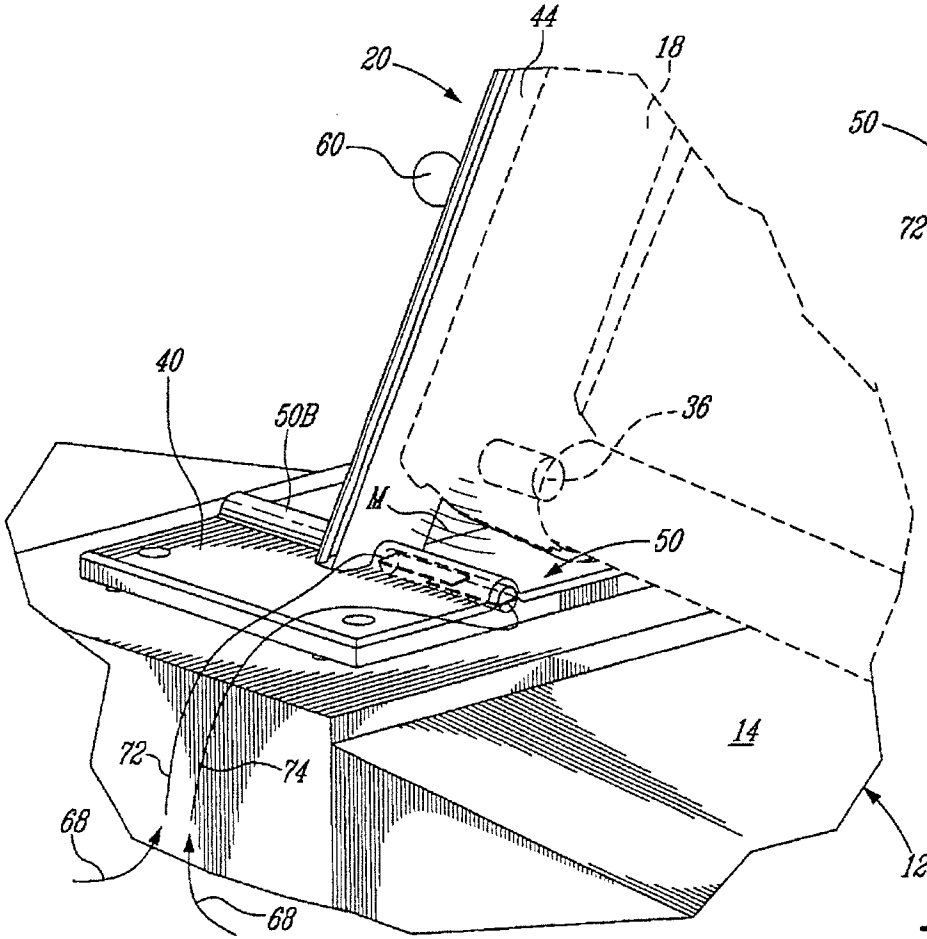
FIG. 9A is front perspective partial view of a fence section of FIG. 1 in a non-signaling position.
Figure 10B:
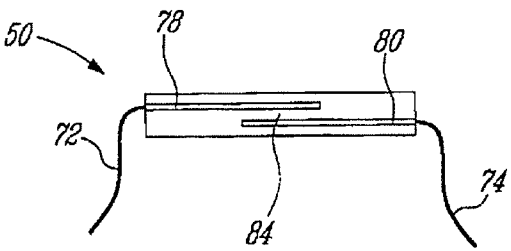
FIG. 10B is a schematic view of the alarm mechanism of the Fence of FIG. 1 in the alarm signaling position.

With reference to FIGS. 1, 2, and 8 to 10B, the alarm system to which the fence sections 16 are linked to in accordance with an illustrative embodiment of the present invention will now be discussed. The fence sections 16 are all wired together and the movement of one will signal an alarm. The description will not enter into all details of how alarm wiring functions since such wiring is well known in the art and needs not be discussed in full detail for concision purposes only. More specifically, an as shown in FIG. 2, a principal wire 68 is passed around the contour of the pool 12 beneath the rim 14 being ultimately connected to an alarm control unit C, shown in FIG. 1, which is mounted to the deck 17. In this way, the principal wire 68 is connected to each post member 20 to be in operational communication with each panel 18. With reference to FIG. 8, a hole 70 drilled through both the rim 14 and the platform 40 is provided in order to connect a pair of auxiliary out-feed and in-feed wires 72 and 74, respectively, to an alarm switch 50 (in this case to alarm switch 50B) as shown in FIGS. 9A and 10A. In this example, only alarm switches 50B of each post members 20 are used. As the skilled artisan will readily appreciate, alarm switches 50A can be used and in a further embodiment, both alarm switches 50A and 50B can be used. Referring particularly to FIGS. 9B and 10B, the switches 50 are reed switches including an envelope housing 76 formed on the platform 40, a pair of magnetizable and electrically conductive reeds 78 and 80.

Figure 10A:
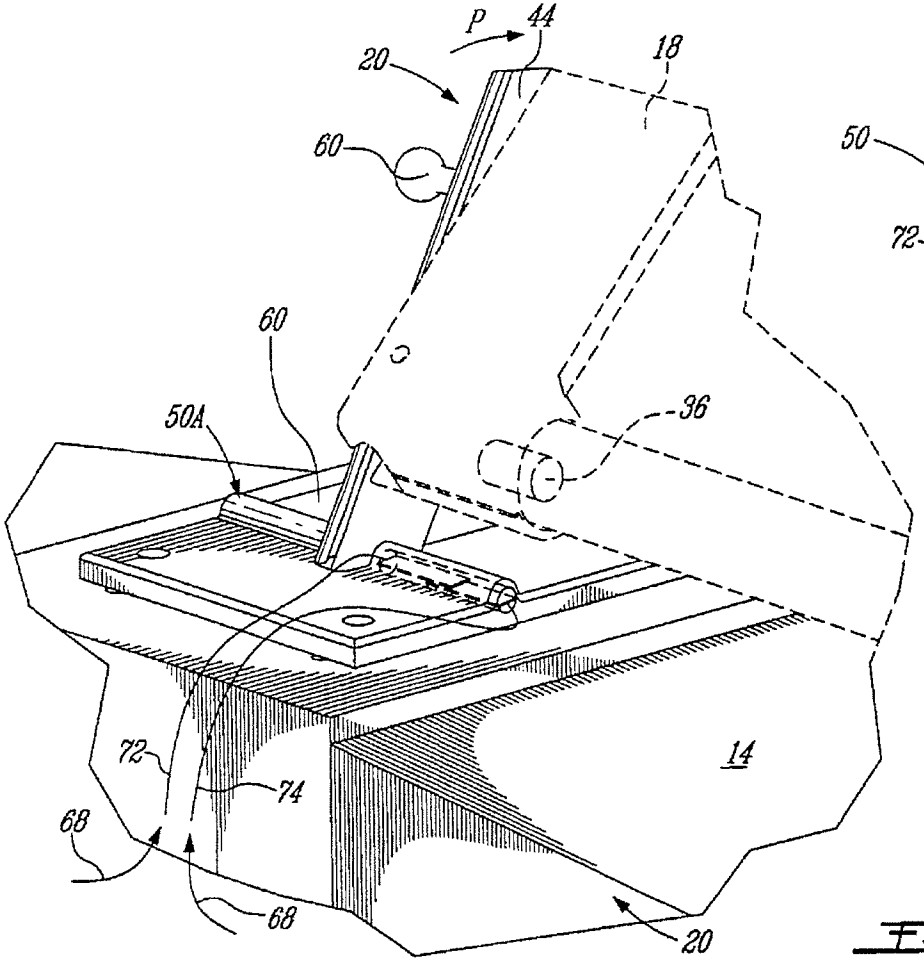
FIG. 10A is front perspective partial view of a fence section of FIG. 1 in the alarm signaling position.

The electrical auxiliary in-feed wire 74 is connected to the principal wire 68 and passes through hole 70 to be connected to the in-feed reed 80. The out-feed reed 78 is connected to the out-feed wire which passes through hole 70 to be connected to the principal wire 68. When the panels 18 are in the upward position as shown in FIGS. 1, 6A, 6B, 7, 8 and 9A, the magnet 36 adjacent the reed switch 50B, provides a magnetic field (as represented by waves M in FIGS. 9A and 9B) causing the reeds 78 and 80 to pull together and close (as shown by contact point 82 in FIG. 9B) thereby providing for current to run through the whole system, fence section by fence section. The fence sections 16 are thus in the non-signalling position. When a given panel 18 is pivoted away from the post member 20 as shown in FIG. 10A in the direction shown by arrow P, the magnet 36 is no longer positioned relative to the switch 50B as to provide the necessary magnetic field M, as such the reeds 78 and 80 open, as shown by space 84 in FIG. 10B, cutting the electrical current running though the fence 10 and thereby signalling the alarm. Hence, at least a given fence section 16 is in the alarm signalling position.

In operation, the panels 18 are positioned in an generally upward position (non-signaling position). In this way, the panels 18 abut the stopper plates 66 preventing the panels 18 from pivoting forward towards the direction of the pool water W. The panels 18 are also in magnetic engagement with the posts 20 preventing them from pivoting backwards in the P direction without sufficient force applied thereon. When a child tries to climb on the pool 12, they will use a panel 18 as a support for lifting themselves upwards or they will try to climb over the fence 10 and hence, they will need to hold on to one or more panels 18. Since there is nothing to support the panel 18 on its rear side (the side that does not face the pool water W), the panels will pivot in the P direction against the magnetic force (of the post and panel mutually mating elements) towards the generally reclined position (FIG. 10A), preventing the child from reaching the pool water W. As mentioned, when the panel 18 is in the generally reclined position (signaling position), this will set off the alarm in order to signal someone in the house for help or for professional assistance to rescue the child, or impaired adult if in fact the subject has reached the water W and is in danger of drowning.

With reference to FIGS. 11 to 16B another non-restrictive illustrative embodiment of the invention will be discussed so as to further exemplify the invention and not limit the scope thereof.

Figure 11:
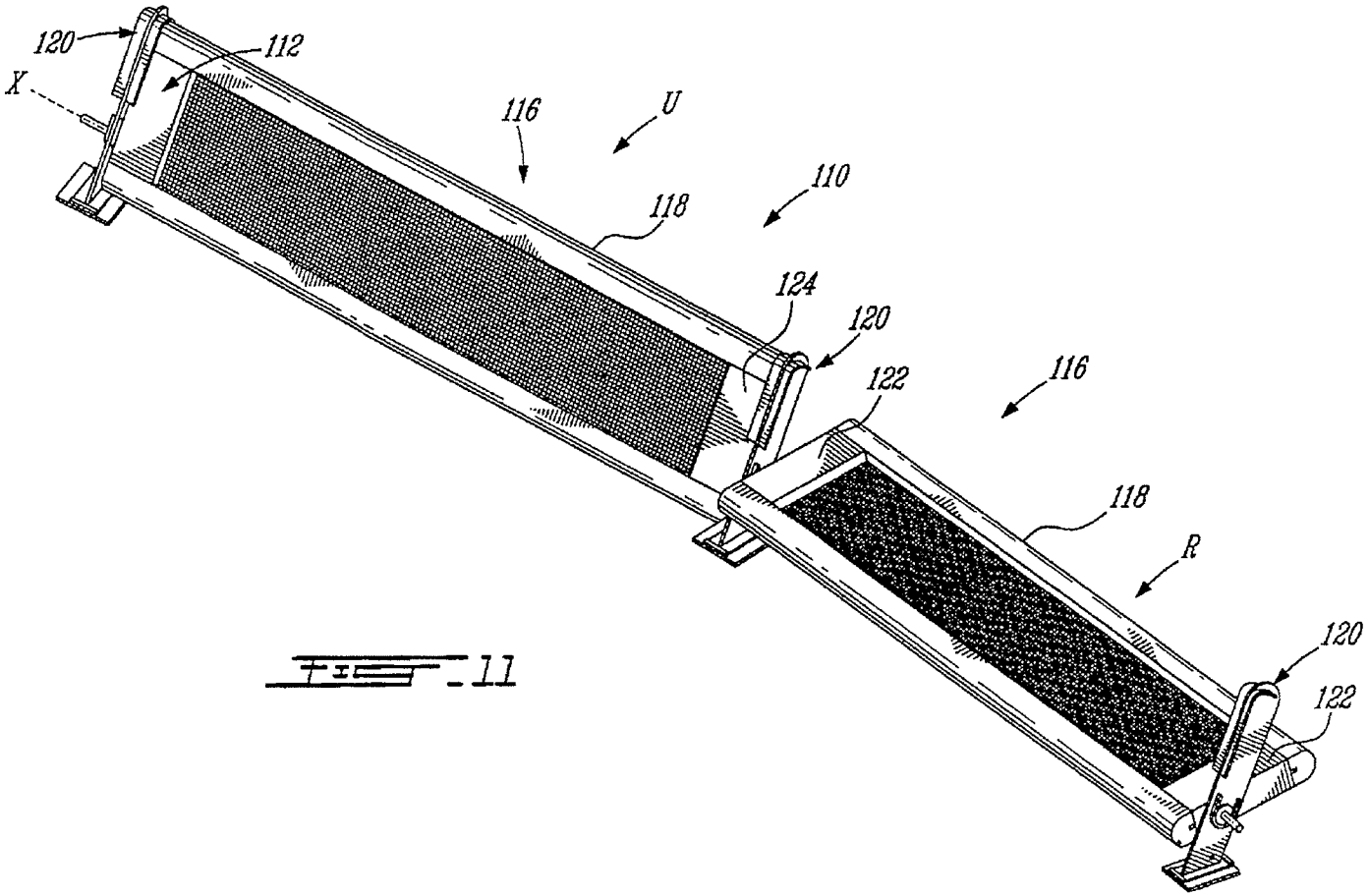
FIG. 11 is a front perspective view of a pair of fence sections of a security fence in accordance with another non-restrictive illustrative embodiment of the present invention showing one fence section in the non-signaling position and the other fence section in the signaling position.

FIG. 11 shows a portion of security fence 110 for a pool 12. The fence 110 is made of a plurality of fence sections or modules 116 in this case including panels 118 mounted to posts 120 at each longitudinal lateral side thereof 122 and 124 respectively.

Figure 12:
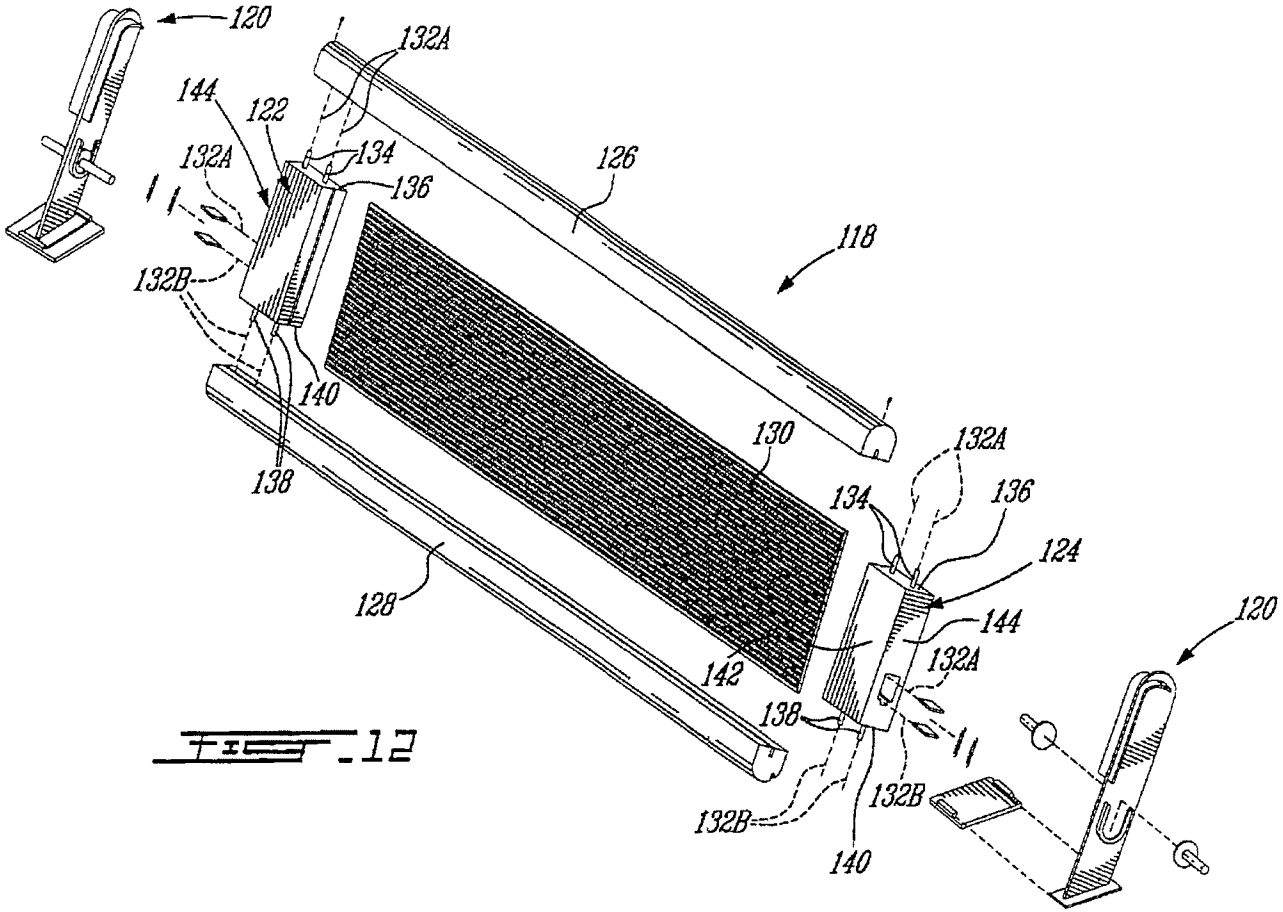
FIG. 12 is an exploded front perspective view of a panel of the security fence section of FIG. 11.

Referring to FIG. 12, each panel 118 includes top and bottom longitudinal frame members 126 and 128, respectively, interconnected via the first and second lateral frame members 122 and 124 (which define the lateral sides). Members 122, 124, 126 and 128 define a frame for supporting a screen 130.

A pair of security wires 132A run within the top frame members 126 and a pair of security wires 132B run within the bottom frame member 128. The security wires 132A extend into the first and second lateral frame members 122 and 124, via a pair of tube sockets 134 on the top face 136 of each lateral frame member 122 and 124. The security wires 132B extend into the first and second lateral frame members 122 and 124, via a pair of tube sockets 138 on the bottom face 140 of each lateral frame member 122 and 124. Both pairs of security wires 132A and 132B extend out of each first and second lateral frame members 122 and 124 via respective openings 142 formed at the outer lateral ends 144 thereof.

Figure 13:
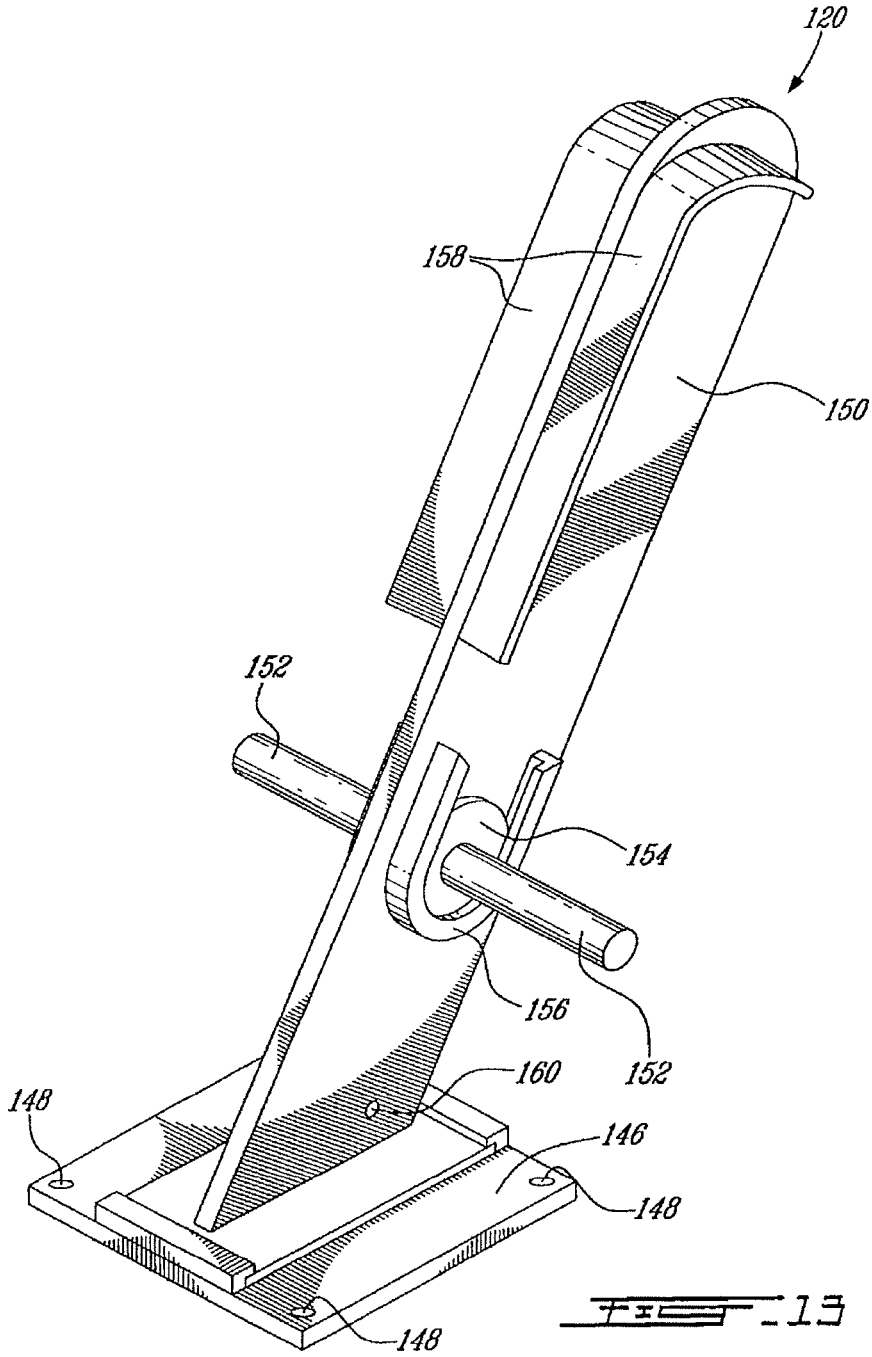
FIG. 13 is front perspective view of a post member of the security fence section of FIG. 11.

With reference to FIG. 13, the panel supporting post member 120 includes a platform 146 that is fixed to the rim 14 of the pool 12 via fasteners 148. A generally vertical plaque 150 upstands from the platform 146 with an inclination that is oriented away from the pool 12. Plaque 150 has two opposite faces which are adjacently mounted to panels 118 via pivot members 152 secured to the plaque 150 with a washer 154 mounted to a U-shaped support 156. Each opposite face also includes a stopper support-member 158 in the form of a semi U-shaped configuration. An aperture 160 is formed in the plaque 150 near the platform 146 so as to receive the security wires 132A and 132B therethrough.

A given panel 118 is pivotally mounted to a pair of adjacent posts 120 at its longitudinal ends 122 and 124 with each opening 142 receiving a pivot rod 152 therein, thereby providing this given panel 118 to pivot about the axis X (see FIG. 11) defined by the pivot rods 152. In this way, the panels 118 are movable between a closed or generally upward position U (non-signaling position) and an open or generally reclined position R (alarm signaling position) shown in FIG. 11

Figure 14:
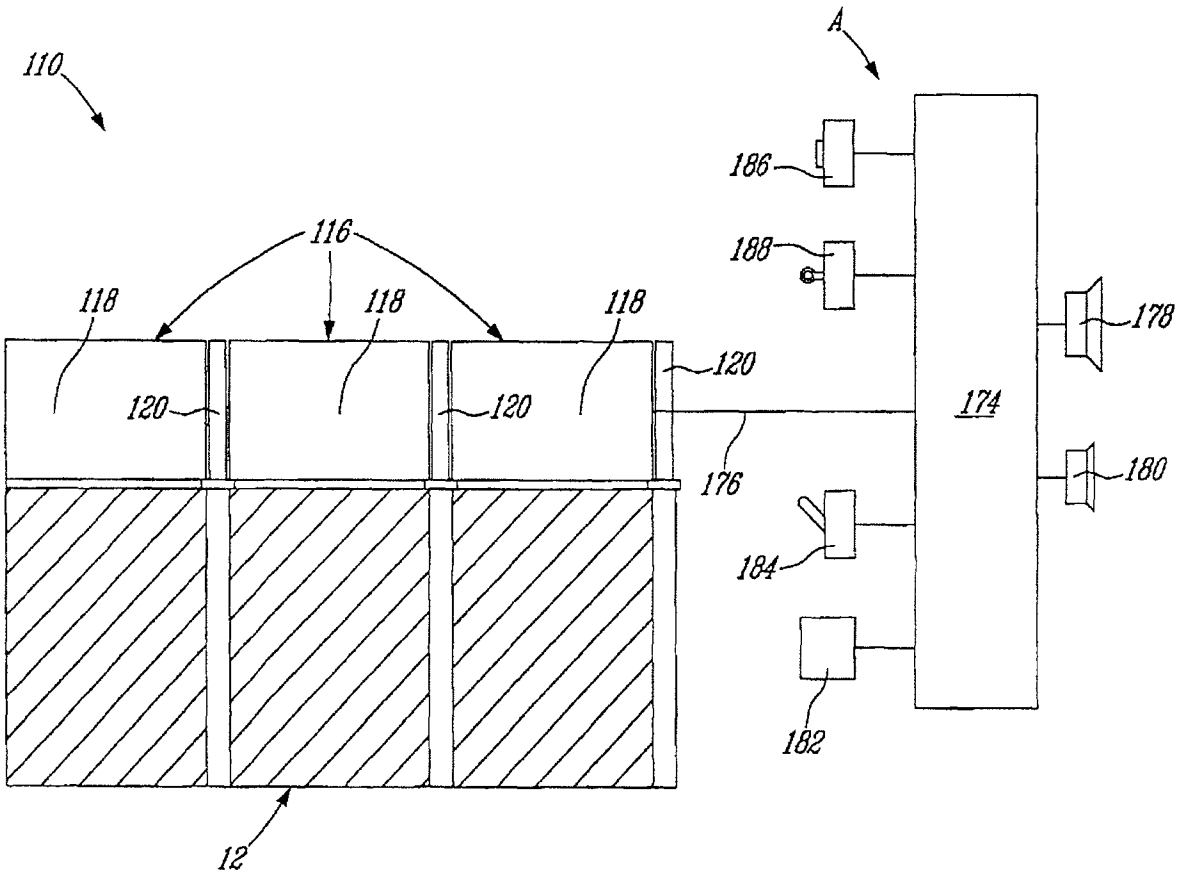
FIG. 14 is a schematic view of the security fence of FIG. 11 linked to an alarm system in accordance with a non-restrictive illustrative embodiment of the present invention.

With reference to FIG. 14, the fence 110 is linked to an alarm system A. More specifically, the wires 132A and 132B run through each panel 118 and post member 120 of every fence section 116 to be ultimately mounted to a control box 174 via a signaling cable 176. The control box 174 includes an sonic alarm 178 and an internal beeper 180. The control box 174 is fed by a power supply 182 and is turned on and off by an interruption switch 184. The control box 174 includes a timer switch 186 as well as a key switch 188 to deactivate the control box 174.

Figure 15A:
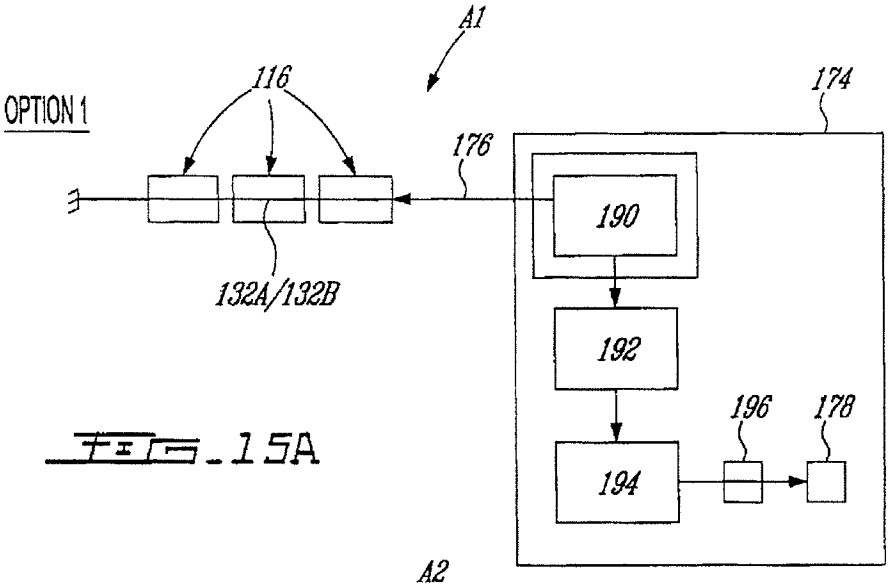
FIG. 15A is a schematic view of a mechanical controlled alarm system for the security fence of FIG. 11 in accordance with a non-restrictive illustrative embodiment of the present invention.
Figure 15B:
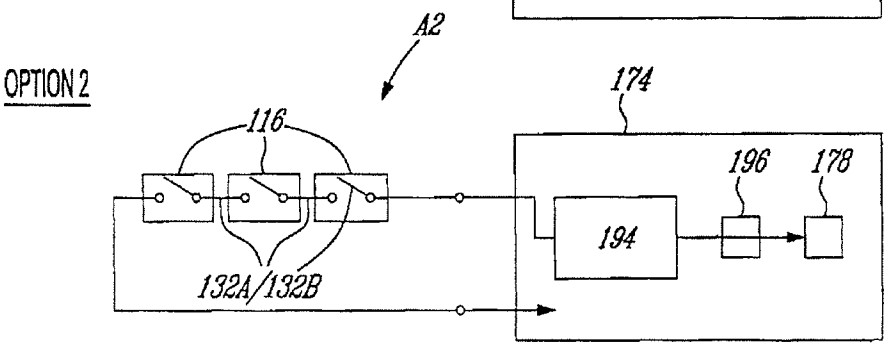
FIG. 15B is a schematic view of an electrically controlled alarm system for the security fence of FIG. 11, in accordance with a non-restrictive illustrative embodiment of the present invention.

With reference to FIGS. 15A, 15B, 16A and 16B, the alarm system A of the present invention can function using a mechanical system A1 (Option 1), shown in FIG. 15A or an electrical system A2 (Option 2), shown in FIG. 15B. In Option 1, shown in FIGS. 15A and 16A, when a fence section 116 is moved from the non-signaling position to the alarm signaling position, the wires 132A and 132B are tugged at and shortened thus pulling on the cable 176 which in turn pulls on a spring 190 thereby acting on a mechanical interrupter 192 which signals a detector 194. The detector 194 sends a signal to an amplifier 196 that is then transmitted to the to the sonic alarm 178. In Option 2, shown in FIGS. 15B and 16A, a constant current passes though wires 132A and 132B when the panels 118 are in the generally upward position U, (non-signaling) and when a given panel 118 is moved towards the generally reclined position R (signaling), there is an interruption in the current this is detected by the detector 194 which sends a signal to the amplifier 196 that is then transmitted to the to the sonic alarm 178.

Hence, position U is a fence section non-signaling position and position R is a fence section alarm signaling position The foregoing alarm system options will be further discussed below in operation.

Figure 16A:
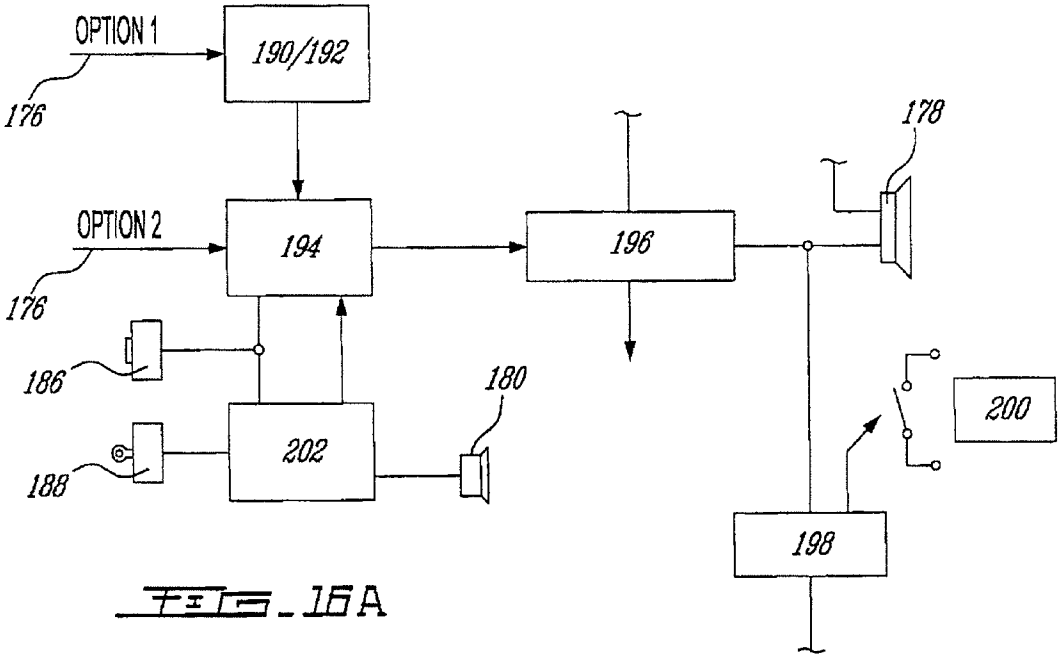
FIGS. 16A and 16B are schematic representations of the alarm control box for the security fence of FIG. 11 in accordance with a non-restrictive illustrative embodiment of the present invention.
Figure 16B:
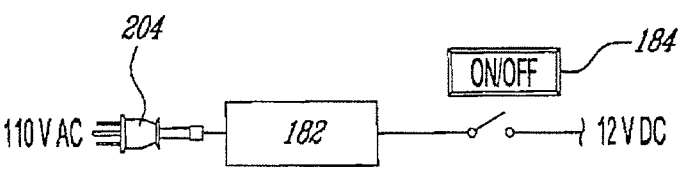

With reference to FIG. 16A, when the amplifier 196 receives a signal (which is detected when a panel 118 is put in the reclined position R as explained above) the signal can be transmitted to a relay box 198 which can relay this signal to an auxiliary alarm 200 (see FIG. 16A).

The alarm systems A1 or A2 can also be linked to an auxiliary monitoring system (not shown) which can signal professional help to arrive onsite.

Referring again to FIG. 16A the signal detector 194 can be linked to a chronometer 202. The chronometer 202 can be configured to deactivate the detector 194 so as not to sound off the alarm 718 when a panel 118 falls to the reclined position R. In this way, when the user starts or times the chronometer 202 via a timer switch 186. the alarm system A1 or A2 is shut down thereby allowing use of the pool 12 without worry if a ball or a hand or any other projectile so impacts a panel 118 causing it to fall to the reclined position R and sounds of the alarm 178. Hence, the alarm 178 does not go off when there is supervision if the user so wishes. In one embodiment, the chronometer 202 can be so configured as to activate the detector 194 after a predetermined amount of time has lapsed. Alternatively, the chronometer 202 after a predetermined amount of time has lapsed may sound off an internal beeper 180 to remind the user to reactivate the detector 194 via switch 186. Alternatively, the detector 194 may be deactivated by a key switch 184 and the timer switch 186 can be started in order to cause the chronometer 202 to sound off the beeper 180 so as to remind the user to reactivate the detector 194 via key switch 188. Alternatively, switch 186 is a reset button which can be pressed once a given panel 118 has fallen and set off the alarm and the user has lifted the panel 118 to its non-signaling position.

The alarm systems A1 or A2 can be turned on and off via power switch 184 which cuts current to the system A1 or A2 that is supplied via power source 182 (which may include a plug 204).

As the skilled artisan will readily appreciate a variety of alarm systems can be provide in order to signal that a fence section 16 or 116 has been moved to a signaling position.

In another embodiment, there are no wires 132A and 132B but a main wire within an elongate top or bottom frame member 126 and 128 respectively. The lateral members 122 and 124 contain compression springs 166 (see FIG. 12) which are actuated by the pivot 152 which can compress the single wire to work as wires 132A and 132B above. In a further embodiment, the pivot 152 will actuate the switch within a given plaque 150 as described above for A2. Of course, a variety of ways of signaling the alarm based on the movement of fence section 116 can be contemplated within the scope of the invention.

The panels 18 or 118 are easily removable form the posts 20 and 120 and hence, maintenance or draining of the pool 12 is easily performed.

Having now described two non-limiting examples of the invention as well as the operation thereof, various non-illustrated and non-limiting embodiments will be described so as to further exemplify the invention.

The fence sections of the invention may be provided in a variety of shapes and sizes depending on the type of alarm system one uses. As such a variety of fence types can be sued such as wire fences, board-fences, chain-link fences, plank-fences, wall-fences and the like that are suitable and commercially acceptable by consumers.

The panel screens may be made of any type of material, in an embodiment, the screen is made of non translucent material to add privacy to users of the pool 12. The panels of the invention may be solar panels and hence auxiliary power supplies would not be needed. The panels may be provided with a variety of alarm signaling mechanisms such as a magnet to act on a reed switch or wiring therein and the like. The skilled artisan can contemplate a variety of designs within the context of the invention.

The posts members as welt as the pivot mechanisms described above may be provided in various constructions as can be contemplated by the skilled artisan to provide for the movement of panels. The upstanding portions of the post members can be provided in the form of poles, plaques and the like as can be contemplated by the skilled artisan.

Both the panels and the posts may be adjustable.

In another non-illustrated embodiment, the security fence of the invention includes door sections 11 which act as doors to the deck 17 overlooking the pool 12. These doors are linked to the alarm C as well so a to set it off when impermissibly opened.

A variety of magnetic and reed combinations and constructions can also be contemplated.

Motion sensors or pressure sensors and GPS systems can also be used to detect whether or not the fence sections of the invention have been engaged.

In another non-illustrated embodiment the security fence of the invention is a contiguous wire system, which detects pressure if it has been engaged. Each fence section refers to a portion of the fence.

In another non-illustrated embodiment, the security fence of the invention is mounted around an in-ground pool and consist of higher vertical fence sections 16.

Various alarm signaling systems can be used be they sound alarms, vibrating units carried by people who are hearing impaired as well as light flashing systems.

It should be understood that all the features of the various previously discussed embodiments herein can be combined in a variety of ways to provide still other embodiments within the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of preferred embodiments thereof, it can be modified, without departing from the spirit and nature of the subject invention as defined in the appended claims.

The invention claimed is:

1. A security fence for a swimming pool, said fence comprising fence sections, said fence sections comprising respective panels pivotally mounted at each respective lateral side thereof to respective post members so as to be pivotable from a generally upward position to a generally reclined positioned relative to said post members at each lateral side thereof when sufficient force is applied thereon.

2. A security fence according to claim 1, wherein a non-signaling position comprises said panels being in a generally upward position and a signaling position comprises said panels being in a generally reclined position relative to said post members at each lateral side thereof.

3. A security fence according to claim 1, wherein said post members are mounted to the perimeter of the pool.

4. A security fence according to claim 1, wherein said post members are inclined away from the pool water.

5. A security fence according to claim 1, wherein said panels and said post members comprise mutually mating elements to be mutually mated-when in said generally upward position.

6. A security fence according to claim 5, wherein said mutually mating elements comprise magnetic elements.

7. A security fence according claim 1, wherein a said fence section comprises stoppers thereby preventing said panel from pivoting in the direction of the pool water.

8. A security fence according to claim 7, wherein said stoppers are mounted to said post members.

9. A fence section for providing a security fence for a swimming pool, said fence section comprising:

at least one pair of post members for being mounted to the pool;

a panel pivotally mountable to said post members at each lateral side thereof so as to be pivotable from a generally upward position to a generally reclined positioned relative to said post members at each lateral side thereof when sufficient force is applied thereon.

* * * * *